United States Patent [19]

Benner, Jr. et al.

[11] Patent Number: 4,872,382

[45] Date of Patent: Oct. 10, 1989

[54] APPARATUS FOR ADJUSTING KNIVES FOR A POUCH FORM, FILL, SEAL MACHINE

[75] Inventors: Harold T. Benner, Jr., Wyoming, Ohio; Paul E. Dieterlen, Covington, Ky.

[73] Assignee: R. A. Jones & Co. Inc., Covington, Ky.

[21] Appl. No.: 182,516

[22] Filed: Apr. 18, 1988

[51] Int. Cl.[4] ..... B26D 7/06; B26D 1/62; B65H 61/08

[52] U.S. Cl. ..... 83/152; 83/100; 83/348; 83/677

[58] Field of Search ..... 83/100, 345, 348, 152, 83/677, 674; 53/133

[56] References Cited

U.S. PATENT DOCUMENTS

| | | | |
|---|---|---|---|
| 3,709,077 | 1/1973 | Trogan et al. | 83/345 X |
| 3,757,620 | 9/1973 | Cloud | 83/345 X |
| 3,832,925 | 9/1974 | Brandt et al. | 83/677 X |
| 4,404,879 | 9/1983 | Frohwerk et al. | 83/345 X |
| 4,485,710 | 12/1984 | Schlisio et al. | 83/677 X |

*Primary Examiner*—Donald R. Schran

*Attorney, Agent, or Firm*—Herron & Evans

[57] ABSTRACT

Apparatus for adjusting the knives of a pouch form, fill, seal machine. The knives are to cut pouches from a web. The knives are mounted in a generally cylindrical cage for radial sliding movement with respect to the cage. An axially movable cone inside the cage has slots in its conical surface that receive the inner ends of the knives. A screw is provided to move the cone axially to change the radial position of the knives.

6 Claims, 6 Drawing Sheets

APPARATUS FOR ADJUSTING KNIVES FOR A POUCH FORM, FILL, SEAL MACHINE

This invention relates to rotary knives for a pouch form, fill, seal apparatus. The apparatus to which the present invention is directed is disclosed generally in U.S. Pat. No. 3,597,898. In that apparatus, a web of heat sealable material is first longitudinally folded upon itself. In that form, it is passed around a sealer which forms transverse seals. Thus, a web of pouches, which are open on one side, is formed. The thus-formed web is passed around a filler wheel where product is introduced into the individual pouches. The upper edge of the web is then sealed to complete the formation of the pouches which are still in web form. The web is then passed around a wheel carrying a series of circumferentially-spaced knives. That wheel cooperates with an adjacent wheel carrying flexible knives which, in scissors fashion, slice across the web in the middle of a seal to separate the web into individual pouches.

It is not unusual for a product manufacturer to run different types of products on a pouch machine. One type product might lightly fill the pouch and another type of product might bulge the pouch considerably. The seals between the pouches must match exactly the cutting edges of the knives that cut adjacent pouches, the center distance between seals forming a chord between the edges of the knives. A full pouch will define a shorter chord than a lightly filled pouch. Blade edges that match the chord of lightly filled pouches would therefore have to be drawn radially inwardly to match the chord of very full, rounded pouches.

At the time of the making of the present invention, the knives had, projecting slightly beyond the edges of the knives, radially adjustable guides. These guides could be extended for the thinly-packed pouches and contracted for the fully-packed pouches so that without changing the knife position, the varying widths of pouches could be accommodated within a narrow range. The time required to make the change of the radially-adjustable guides, normally twelve of them, was about twenty minutes. Following the change, a web would be run to see if the change provided precise cuts centered on the seals. If the adjustment was not entirely satisfactory, a further refinement was made. As indicated, these adjustments could be made within the narrow range since the actual knife edge was not changed. For a greater range of changes of approximately one-half inch of radial position of the knife edge, shims were provided to change the mounting of the respective knives. A change where the knives were shimmed would take considerably longer.

An objective of the present invention has been to provide apparatus for facilitating the adjustment of the radial position of the edges of the knives on rotary cutting apparatus.

This objective of the invention has been attained by providing a cage in which the knives are mounted for radial movement only. Within the center of the cage, a cone having a conical surface supports the inner edge of each knife. The cone is threaded to a screw passing through the axis of the cage so that upon rotation of the screw the cone moves axially with respect to the cage. When the cone moves axially, the knife blades, mounted on the conical surface, move radially in or out. Thus, with a simple but precise turning of the screw, a very precise and simultaneous change of the radial locations of all knife edges can be made, the change being made within a minute or so as contrasted to the time-consuming adjustment previously required.

In one form of the invention, it is preferred to have suction cups mounted on the cage between knife edges. The suction cups grip the severed pouches and release them onto a conveyor on which pouches are to be carried away. When the knife blades have their radial positions changed, so, too, should the radial position of the suction cups be changed. This change is accomplished quite efficiently by mounting the suction cups for radial sliding movement with respect to the cage and providing a slidable connection of the inner end of each suction cup to the cone so that as the cone is moved axially to change the blade positions, so, too, will it change the radial position of the suction cups.

The several features of the present invention will become more readily apparent from the following detailed description taken in conjunction with the accompanying drawings in which.

Figure 7:
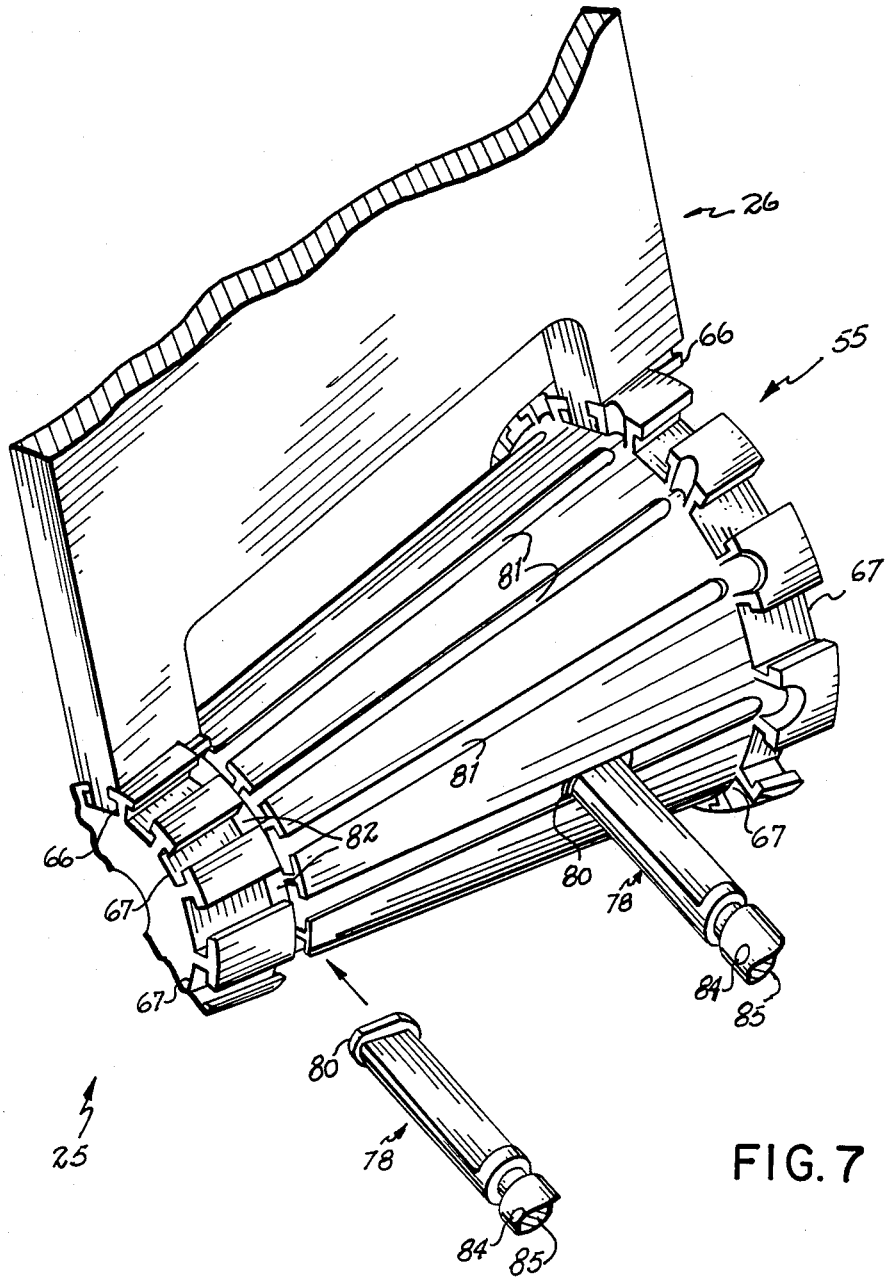

FIG. 7 an isometric partially disassembled view of the cone of the present invention.

Figure 1:
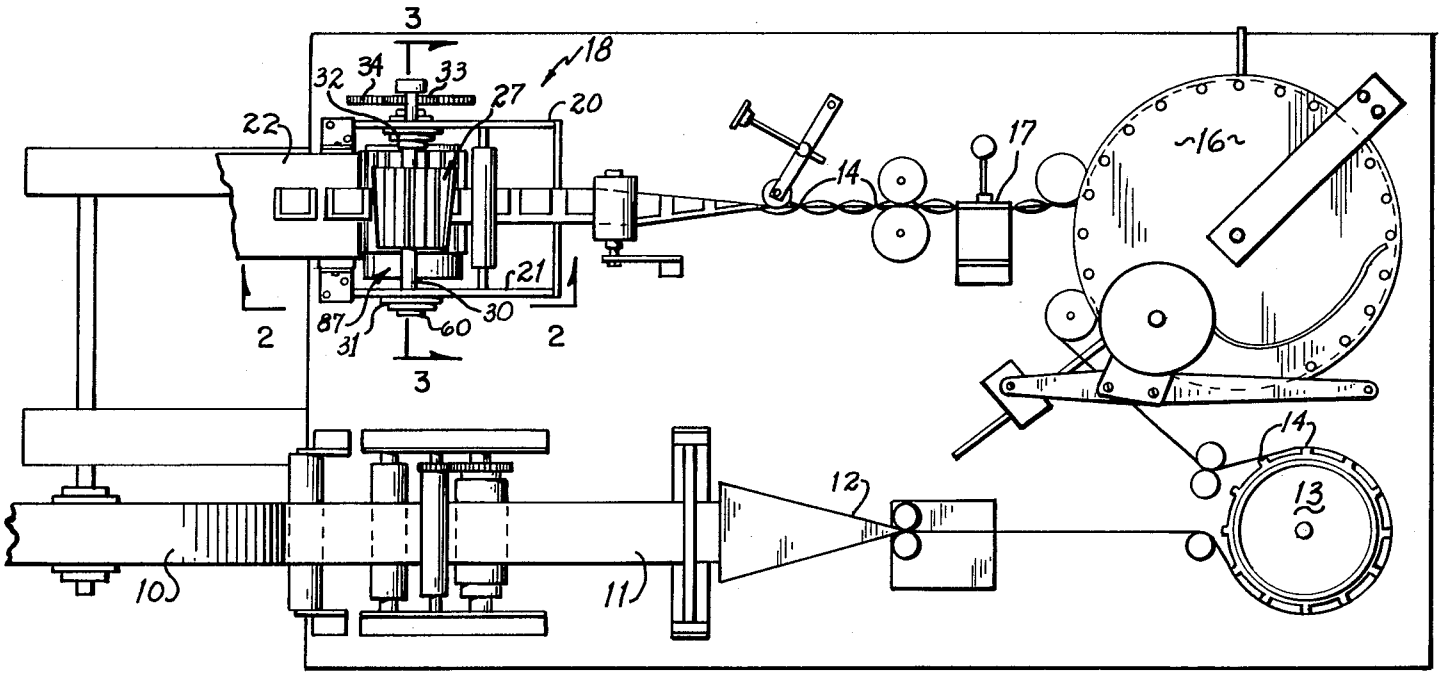
FIG. 1 is a diagrammatic plan view of the pouch form, fill, seal machine of the present invention.
Figure 2:
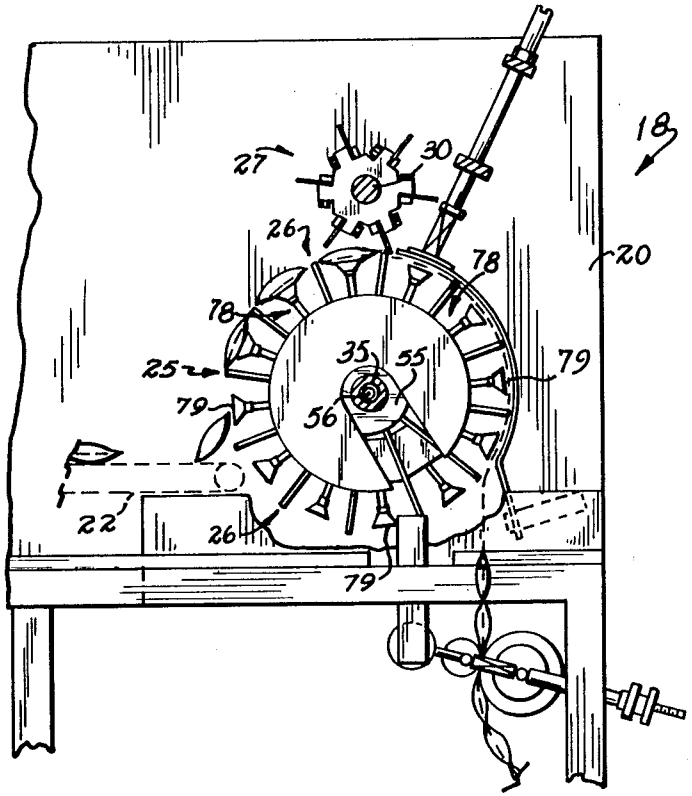
FIG. 2 is a cross-sectional view taken along lines 2—2 of FIG. 1.
Figure 3:
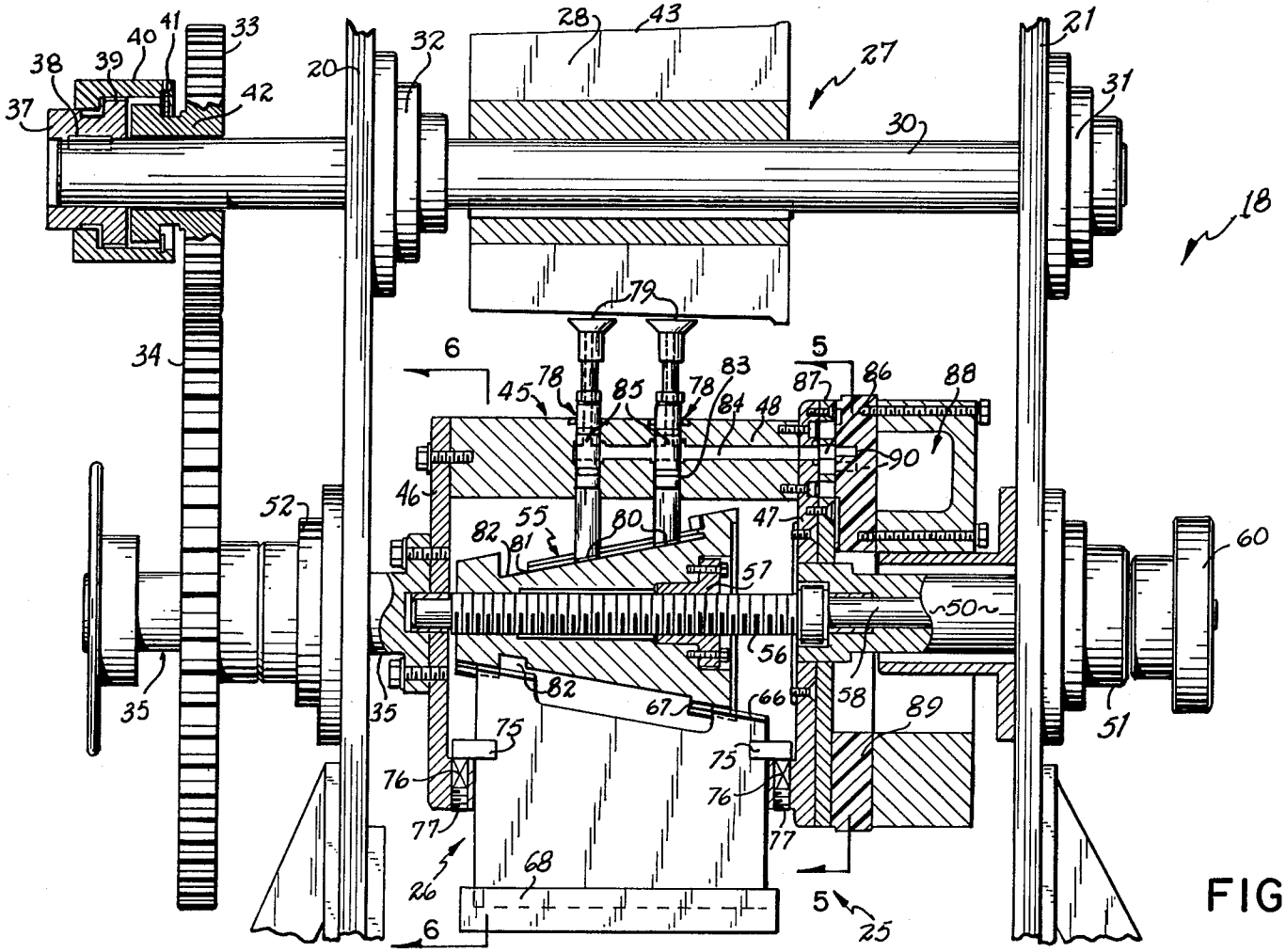
FIGS. 3 and 4 are cross-sectional views taken along lines 3—3 of FIG. 1.
Figure 4:
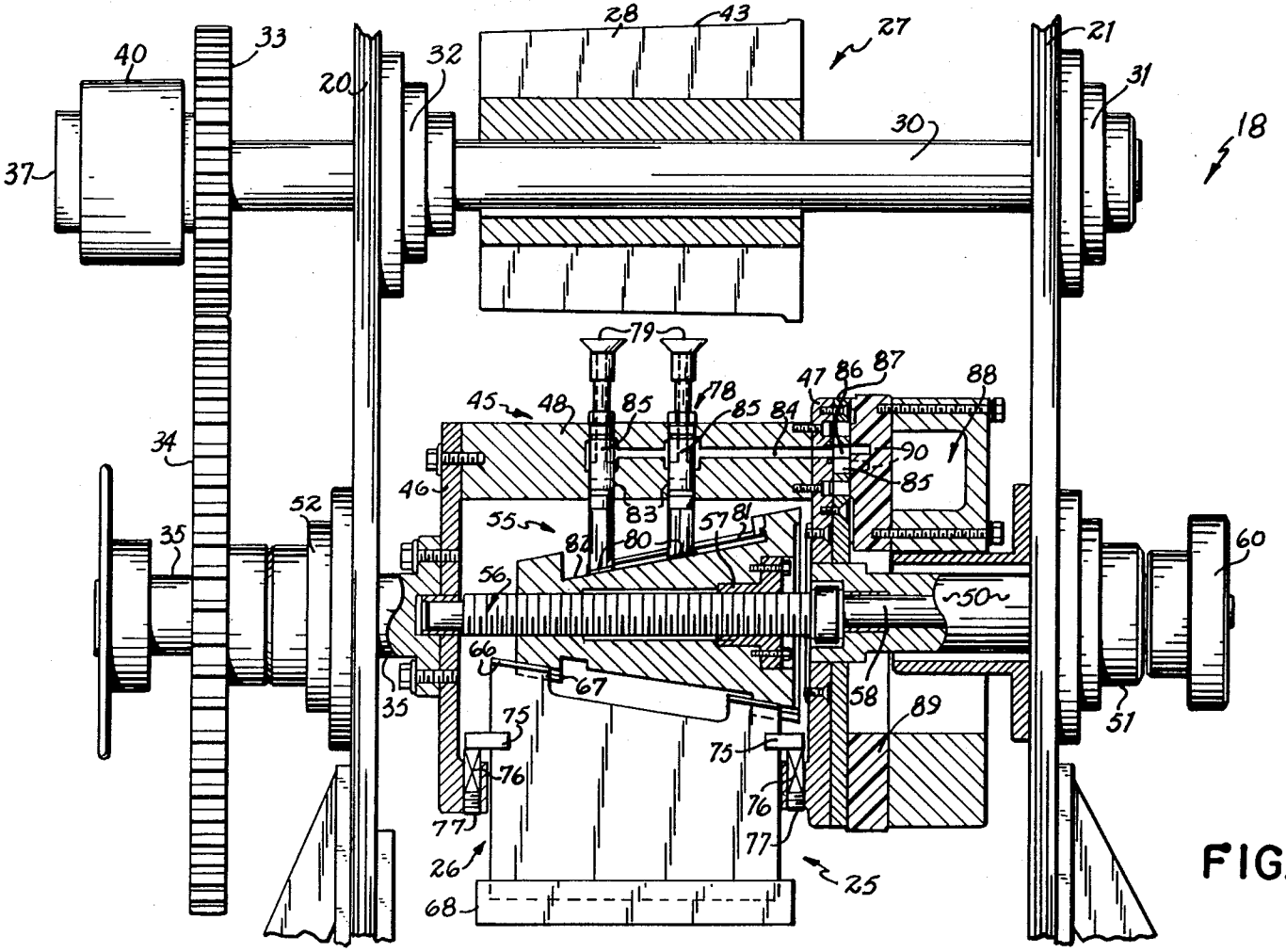

Referring to FIG. 1, the pouch form, fill, seal machine has a web supply 10 feeding an unfolded web 11 through a plow 12 that folds the web upon itself. The thus-folded web, with upwardly-facing edges, is passed around a sealing wheel 13 to form individual transverse seals 14 and to create open-ended pouches. The open-ended pouches are passed around filling apparatus 16 during which the pouches are filled. The web with filled pouches is then passed through an upper edge-sealing apparatus 17 that seals off the open mouths of the pouches. The web of pouches is then preferably rotated through 90° and passed through the cutting apparatus 18. The cutting apparatus 18 is mounted between two supports 20 and 21. These can be in the form of metal walls to form a chamber where cutting apparatus of FIGS. 2–4 is mounted.

The cutting apparatus includes a driving knife 25 of twelve blades 26 and a driven knife 27 of six blades 28. This number of blades of course is for one form of the apparatus, the number being varied with other sizes of pouches.

The driven knife 27 is mounted on a shaft 30 which is mounted in bearings 31 and 32 and has a gear 33 on the end of the shaft outside of the support 20. The gear 33 is driven by a driving gear 34 on a shaft 35 for the driving knife 25.

The end of the shaft 30 is connected to a collar 37 by a key 38. The collar 37 has a spline connection at 39 to a sleeve 40. A set screw 41 in the sleeve 40 is provided for fixing the sleeve 40 to the hub 42 of gear 33. This mechanism, just described, permits a change in the angular position of the blades 28 of the driven knife with respect to the driving knife in order to accommodate a change in radius of the edge of the blades 26 of the driving knife 25. In this regard, the blades 28 of the driven knife are flexible and have tapered edges 43. To shear the pouches from the web, the edge of driving blade 26 contacts the edge of driven blade 28 at the right side of the blades as viewed in FIG. 3 with the blades wiping across each other in a shearing action as the knives rotate together. If the radial position of the edge of driving blade 26 is changed, then its point of engagement with the driven blade 28 would change. Consequently, the angular position of the driven blade must be changed to restore the contact point of the two blades.

The driving knife 25, wherein the primary adjustment of the present invention is made, includes a cage 45 formed primarily by a plate 46, a plate 47 axially-spaced from it, and a plurality of trapezoidal bars 48 (FIG. 6) bolted between the plates 46 and 47. Plate 46 is bolted to the shaft 35 and is rotated by it. Plate 47 is mounted on a shaft 50 that is supported in bearings 51 on the support 21. The shaft 35 is supported in bearings 52 mounted on the support 20.

A cone 55 is centered within the cage 45. A screw 56 is threaded onto a nut 57 fixed to the cone 55 so that rotation of the screw causes the cone to move axially back and forth within the cage. The screw is fixed to a shaft 58 within the shaft 50 and is connected to an external handle 60. Rotation of handle 60 with respect to cage 45 causes rotation of the screw 56 with respect to the nut 57 which causes axial movement of the cone 55.

Figure 6:
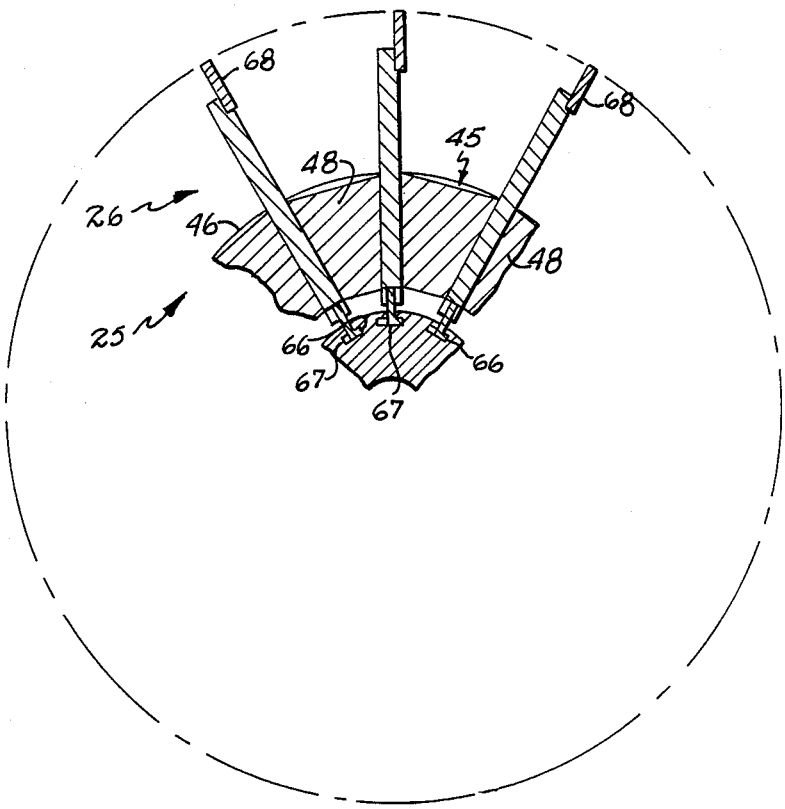
FIG. 6 is a partial cross-sectional view taken along lines 6—6 of FIG. 3.

The twelve knife blades 26 are uniformly spaced around the cage 45. Each blade has an L-shaped inner edge 66 (FIGS. 6 and 7) that is slidable in its T-shaped slot 67 formed on the cone 55. Each blade carries an edge member 68 that cooperates with a flexible blade 28 on the driven six-bladed knife 27 to provide a shearing action across the seal of each pouch. Each blade 26 projects radially between adjacent trapezoidal bars 48 as shown in FIG. 6 and is radially slidable with respect to the bars 48. Each blade carries axially-projecting blocks 75. The support plates 46 and 47 carry springs 76 that bear against the blocks, the spring 76 being held in place by set screws 77 threaded into the plates 46 and 47. Thus, the knife blades 26 are always urged, in a radial direction, snugly against the cone 55.

It can be seen that by rotating the handle 60, the screw 56 rotates carrying the cone axially within the cage 45. As the cone moves toward the left, it drives the knife blade 26 radially outwardly. As it moves toward the right, it contracts the knife blade 26 radially inwardly.

Each trapezoidal bar has a pair of suction cup mounts 78 radially, slidably mounted in radial bores 83 in the bars. Each mount carries suction cup 79. The inner ends of the mounts carry small disks 80 (FIG. 7) that are slidably mounted in T-shaped slots 81 in the cone 55. The slots 81 are disposed between the T-shaped slots 67. Each slot 81 has an enlarged opening 82 through which the disk 80 can pass in order to insert the radial inner end of the suction cup mount 78 into the cone for retention thereby.

Figure 5:
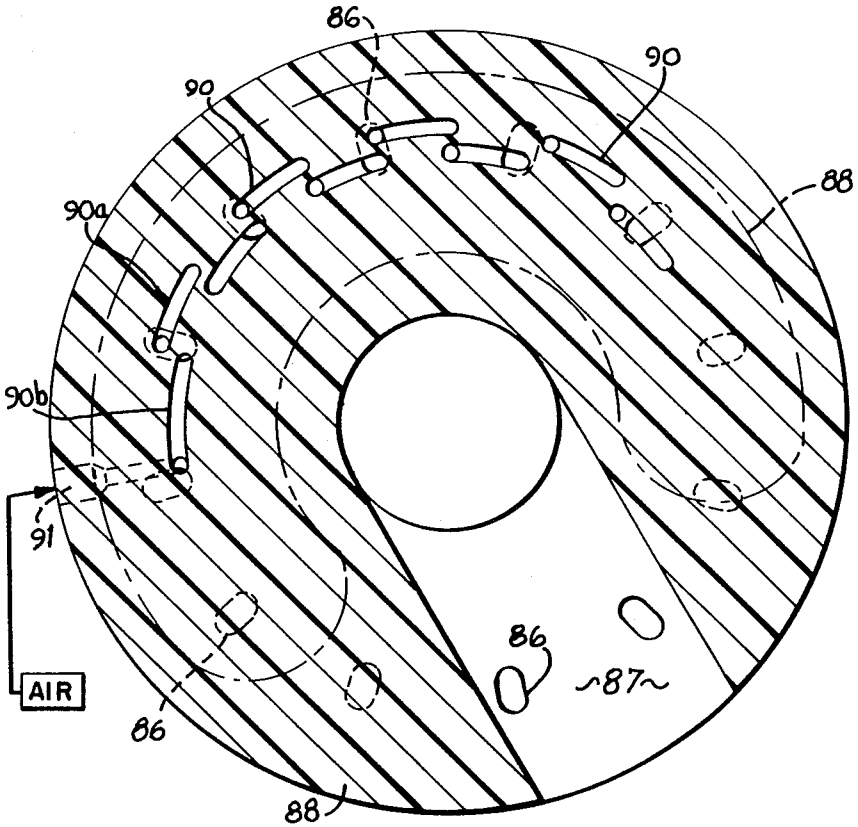
FIG. 5 is a cross-sectional view taken along lines 5—5 from FIG. 3.

Each trapezoidal bar 48 has an axial passageway 84 communicating with the radial bores 83. Each suction cup mount 78 has a radial passageway 85 to the suction cup. Each axial passageway 84 is connected to a respective port 86 in a rotating plate 87 bolted to the plate 47 (FIGS. 3, 4 and 5). That plate 87 rotates with respect to a fixed vacuum manifold 88 that carries a shoe 89 which rides on the rotating plate 87. The shoe 89 carries a a plurality of staggered arcuate slots 90 which communicate with manifold 88. When a port 86 overlies arcuate slot 90, the passage 84 connects vacuum manifold 88 to the suction cup 79. That vacuum connection is made at approximately the time the cut is made through the seal of each pouch to be gripped by the vacuum cups and the vacuum is maintained until its port 86 moves past the next to last slot 90A at that point vacuum to the cups is discontinued. Last slot 90B does not communicate with manifold 88; rather, it is connected by port 91 to a source of air under pressure. When port 86 reaches slot 90B, a puff of air drops the pouch onto a conveyor 22 (FIG. 2) below the knife.

The arcuate slots 90 are interrupted and staggered so that if a pouch drops off a cup causing the cup to lose vacuum, that cup will remain isolated from the adjacent cups.

In the operation of the invention, when the pouch chord changes, that is, the center distance between adjacent seals changes, the radial position of the edges of blades 26 must be increased or decreased to match the chord length between pouches. To change that radial position, the handle 60 is rotated, thus rotating screw 56 which in turn drives the cone 55 axially to the left or right. Axial movement of the cone moves the knives and suction cups radially to change the chord defined by the edges of adjacent knife edges 68 to match the chord between adjacent pouches.

As explained above, when the radial position of the edges of the blades 26 is changed, the angular position of the flexible blades 28 require a corresponding change so that the shearing action between the blades begins at the proper point. To make the change in the driven knife that carries the flexible blades 28, set screw 41 is loosened and the sleeve 40 is rotated to rotate the shaft 30 on which the driven knife is fixed. After that change is made, the set screw is tightened to fix the shaft and knife in the desired position. These adjustments having been made, the cutting apparatus is ready for operation.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. An adjustable knife assembly for a web of filled pouches comprising, a cage having an axis of rotation, a screw mounted within said cage on said axis of rotation, a cone disposed within said cage and mounted on said screw for axial movement upon rotation of said screw, said cone having a conical surface, a plurality of axially-extending T-shaped grooves uniformly spaced about the conical surface of said cone, a radially-extending knife blade slidably mounted in each of said grooves, each said blade having a radial inner edge which has a lateral flange slidable in said T-shaped groove to move said blade radially in and out as said cone moves axially back and forth, means on said cage for supporting each said knife blade in a radial position and blocking axial movement while permitting radial movement, whereby rotation of said screw causes said cone to move axially with respect to said cage, the axial movement of said cone causing radial movement of said knife blade.

2. A knife assembly as in claim 1 in which said supporting means for said cup comprises, a pair of axially-spaced plates, a bar for each suction cup mounted between the plates and slidably receiving a respective suction cup mount, an axially-extending air passageway in said bar communicating between said suction cup mount and one of said plates, and means for selectively applying a vacuum to said passageway.

3. A knife assembly as in claim 2 in which said bars are spaced apart circumferentially by the thickness of a knife blade, each said knife blade projecting between adjacent bars and being supported by said bars.

4. An adjustable knife assembly for a web of filled pouches comprising, a cage having an axis of rotation, a screw mounted within said cage on said axis of rotation, a cone disposed within said cage and mounted on said screw for axial movement upon rotation of said screw, said cone having a conical surface, a plurality of axially-extending grooves uniformly spaced about the conical surface of said cone, a radially-extending knife blade slidably mounted in each of said grooves, means on said cage for supporting each said knife blade in a radial position and blocking axial movement while permitting radial movement, a plurality of radially-extending suction cup mounts each terminating in a suction cup, said suction cup mounts being uniformly spaced around the circumference of said cage between said knife blades, said cone having a plurality of axially-extending cup grooves on the conical surface of said cone, said cup mounts each having an inner end slidably-mounted in a respective cup groove, means on said cage for supporting each said cup mount for radial movement while blocking axial movement, whereby rotation of said screw causes said cone to move axially with respect to said cage, the axial movement of said cone causing radial movement of said knife blade and said suction cups.

5. A rotary knife for cutting a web of material comprising:

a rotary support, a plurality of knife blades mounted on said support and equiangularly spaced about said support, each knife blade terminating in an edge, and means for simultaneously and uniformly moving said blades radially with respect to said support to change the radial position of all said blade edges, a cooperating rotary second knife mounted adjacent said first rotary knife and having a plurality of blades cooperating with the blades on said first knife to cut said web in scissors fashion, and means for changing the rotary position of said second knife with respect to said first knife to accommodate radius changes in the edges of said first knife.

6. An adjustable knife assembly for a web of filled pouches comprising, a cage having an axis of rotation, said cage including a pair of axially-spaced plates, a screw mounted at the center of said cage on said axis of rotation and projecting axially beyond one of said plates, means for rotating said screw by engagement with said extension, a cone disposed within said cage and mounted on said screw for axial movement upon rotation of said screw, said cone having a conical surface, a plurality of axially-extending T-shaped grooves uniformly spaced about the conical surface of said cone, a radially-extending knife blade slidably mounted in each of said grooves, each said blade having two axially-spaced radial inner edges, each of which has a lateral flange slidable in said T-shaped groove to move said blade radially in and out as said cone moves axially back and force, means on said cage for supporting each said knife blade in a radial position and blocking axial movement while permitting radial movement, whereby rotation of said screw causes said cone to move axially with respect to said cage, the axial movement of said cone causing radial movement of said knife blade.

* * * * *